United States Patent [19]

Jansson

[11] 4,356,640

[45] Nov. 2, 1982

[54] METHOD OF DRYING CLOTHES AND HEATING UP LAUNDRY WATER AND APPARATUS THEREFOR

[76] Inventor: Christian Jansson, Rötelstr. 24, 6300 Zug, Switzerland

[21] Appl. No.: 266,459

[22] Filed: Jan. 19, 1981

[30] Foreign Application Priority Data

Jul. 2, 1980 [CH] Switzerland ..... 5107/80

[51] Int. Cl.[3] ..... F26B 3/34

[52] U.S. Cl. ..... 34/1; 34/4; 34/39; 34/133

[58] Field of Search ..... 34/1, 4, 133, 39; 219/10.55 R, 10.55 M, 1

[56] References Cited

U.S. PATENT DOCUMENTS

| | | | |
|---|---|---|---|
| 3,269,027 | 8/1966 | Harnden, Jr. | 34/48 |
| 3,276,138 | 10/1966 | Fritz | 34/1 |
| 3,440,383 | 4/1969 | Smith | 219/10.55 R |
| 3,605,272 | 9/1971 | Boucher | 34/1 |
| 3,854,219 | 12/1974 | Staats | 34/1 |

*Primary Examiner*—Larry I. Schwartz
*Attorney, Agent, or Firm*—Weinstein & Sutton

[57] ABSTRACT

The present invention provides a method and apparatus for exposing laundry to be dried and/or laundry water to be heated to a source of radiation. In addition, the source of radiation is disposed so that it is transmitted substantially loss-free between the radiation source and the water or moisture which is to receive the energy. In one embodiment, a microwave generator is employed and is disposed as a compensation weight on the drum box of the drying and/or washing machine. Preferably, the drum box is made out of metal and has a plastic ring through which the microwave generator can transmit the microwave radiation. The microwave radiation passes through the plastic ring with relatively low loss and then passes through the air without loss to the moisture contained in the laundry in the drum, so that the laundry is heated up and dried by absorption. As a result, there is a considerable increase in efficiency.

12 Claims, 7 Drawing Figures

METHOD OF DRYING CLOTHES AND HEATING UP LAUNDRY WATER AND APPARATUS THEREFOR

BACKGROUND OF THE INVENTION

The present invention relates generally to a method and apparatus for applying heat to dry wet laundry and/or to heat up laundry water for the washing of laundry, and also relates to a washing machine and/or dryer for accomplishing the method.

Typically, laundry dryers are very poorly designed with regard to their power consumption. This is true for machines which only dry laundry, so called tumblers, as well as for combined washing/drying machines. In fact, the energy consumption for drying clothes is so high that very often the users of combined washers and dryers leave out the drying phase of the cycle and, to save energy, prefer to dry their laundry in other ways, such as by hanging it out to let the air dry it.

One reason for the low efficiency as concerns power consumption of conventional methods of drying clothes results from the fact that the method employed is that, in such conventional dryers, or washers/dryers, the air is first heated up, and then the heated air is passed over the laundry to be dried.

Broadly, it is an object of the present invention to provide an improved method and apparatus for overcoming the aforesaid drawbacks. Specifically, it is within the contemplation of the present invention to provide an improved arrangement which is inexpensive and highly efficient.

SUMMARY OF THE INVENTION

Briefly, in accordance with the principles of the present invention, a method is provided for drying wet laundry and/or heating laundry water which includes the steps of providing a container for the laundry to be dried and/or washed, providing a source of radiation energy, directing the radiation energy to the wet laundry to be dried and/or to the water to be heated in the container, and causing the radiation energy to pass from the source to the wet laundry and/or to the laundry water in a manner such that substantially all of the radiation energy is absorbed by the moisture in the laundry to be dried and/or the laundry water. In the preferred embodiment, a microwave transmitter is employed as the source of radiation energy. In addition, in order to prevent the wet laundry from being overheated by the radiation at a local pattern, the present invention also envisions that the source of radiation and the wet laundry are moved relative to each other. Further, in order to allow for different types of fabrics to be dried in accordance with their sensitivity to heat, the present invention also envisions that the intensity of the radiation may be adjusted in proportion to the amount of moisture in the wet laundry to be dried.

In addition, in accordance with the principles of the present invention, there is also provided an apparatus for drying wet laundry and/or heating laundry water which includes a container for the laundry, with the container having a transmission opening, and a source of radiation energy for transmitting the radiation energy through the opening of the container to the wet laundry to be dried and/or to the water to be heated in the laundry container. In addition, the relative movement between the radiation source and the laundry is achieved, in the preferred embodiment, in that the container for the laundry is a drum suspended in a housing driven by a power unit. In addition, in the preferred embodiment, during the drying process of the wet laundry, the present invention envisions that the container is at least partially formed of plastic in order to form a transmition opening for the radiation energy.

In addition, in the preferred embodiment, where the source of radiation is a microwave generator, the generator may be mounted on the drum box which houses the drum as a compensating weight. Such compensating weights have always to be provided and thus using its volume for the generator provides for very compact arrangement.

In one embodiment of the present invention, the output or wave guide for the radiation source is mounted on the front of the drum, with the drum having a transmission opening for the radiation energy. In this manner, this opening serves the dual function as an opening for loading the laundry and also as an opening for the transmission of radiation energy. In such an arrangement, the output or wave guide of the microwave generator extends through the door for the closing of the container opening, or alternatively, the door is provided with a radiation permeable section for the transmission of the radiation through the door.

For heating the washing water in the washing process, there are customarily provided heating rods, which are in direct contact with the laundry water. This ensures efficient contact between heating source and water to be heated.

It is obvious that this technique of direct contacting may not be used in drying process as the laundry would then be locally burnt.

Here the problem occurs to transmit heating energy via the air to the moisture without heating up the air but mainly the moisture for saving energy.

Thus the present invention is primarily directed to drying process but can nevertheless, once installed, also be used in the washing process.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED EMBODIMENTS

Figure 1:
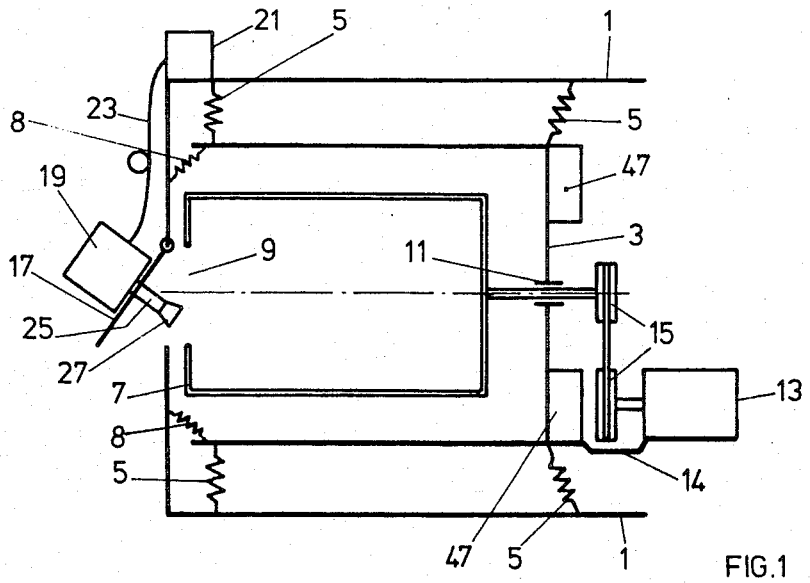
FIG. 1 is a schematic layout of a laundry drum disposed in a drum box suspended on a machine housing by springs, with a microwave generator mounted on a coaxial door opening for the machine.
Figure 2A:
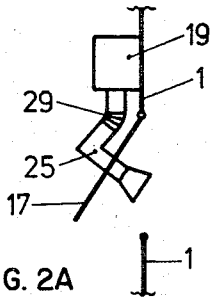
FIGS. 2*a* and 2*b* show alternate embodiments in which the microwave generator is mounted on the housing, and a flexible wave guide is provided and connected to the door of the machine.
Figure 2B:
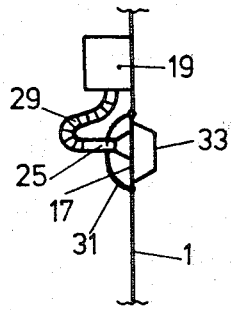

Referring to FIG. 1, a washing or drying machine is shown having a housing 1 and a door 17. A drum box 3 is suspended by springs 5 on the housing 1, as in conventional washing or drying machines. Mounted within the drum box 3 is a drum 7 having a coaxially-arranged opening 9 for loading laundry, and the drum 7 is supported for rotational movement on the opposite side of opening 9 in a bearing 11 located in the wall of the drum box 3. A power unit 13 is connected with linkage 14 to drum box 3 and drives drum 7 through a conventional V-belt and pulley arrangement 15 connected to the shaft extending through bearing 11.

Through door 17, laundry is loaded through opening 9 into the drum 7. On door 17, there is mounted a microwave generator 19 which may be, for example, a Magnetron. In this manner, a power unit 21 for the generation of the high voltage necessary can be separate from the Magnetron 19 and can be connected to the Magnetron through a cable 23 permanently mounted on the housing 1 in order to minimize the weight and volume of the apparatus which must be mounted on door 17. The output of the microwave generator 19 is supplied to the wash drum 7, when the door 17 is closed, through a wave guide 25 which then extends through the door 17. In addition, the wave guide is provided with a radiation opening 27. The output circuit of the wave guide 25 has to be matched to the impedance of the drum 7, either through appropriate design or by installing a tuning device as known in microwave technique. In order to protect the microwave generator 19 from destruction through power reflection caused by unproper impedance matching a directional detector can be installed, whose output signal can turn off the microwave generator at the correct time to prevent such damage.

The drum 7 is made to prevent leakage of microwave radiation to the outside, when the door 17 is in its closed position. This is achieved by the use of appropriate door seals and with flexible electrically conducting sealing connections 8, which are connected between the housing 1 and the drum box 3.

In the embodiment shown in FIG. *2a*, the microwave generator 19 is rigidly mounted on the housing 1, and the generator 19 is connected to the wave guide 25 mounted on the door 17 by means of a commercially-obtainable flexible wave guide coupling 29. A similar arrangement is also shown in FIG. *2b*. Since the loading doors of washing machines are typically made of plastic, it is entirely possible, instead of having the wave guide 25 to extend through the door, to have it extend in close proximity to the door as shown in FIG. *2b*, since the plastic opening 33 transmits the microwave radiation with relatively low loss. In addition, in order to prevent stray radiation of the microwave power, a metal shield 31 can be provided around the door 17, in conjunction with the plastic opening 33.

Figure 3:
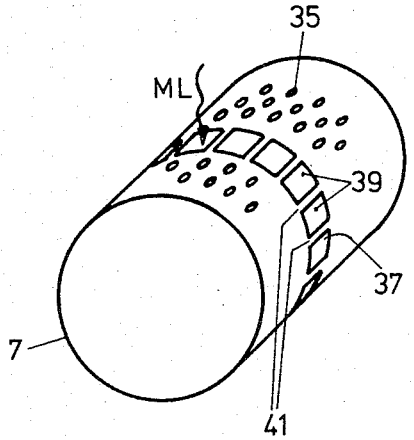
FIG. 3 is a schematic representation of a laundry drum having an annular section thereof permeable to microwave radiation.

A still further embodiment is encompassed by the present invention. In order to mount the microwave generator 19 on the housing 1, on another preferred surface, and to have the connection somewhere on the drum, the entire drum 7 can be formed of plastic. In another variation, as shown in FIG. 3, a conventional drum 7, made of metal, is employed having water holes 35. However, the water holes 35 are too small for a loss-free coupling of the microwave signal into the drum 7 for the preferred frequencey of 2.45 GHz to be used. Therefore, it is preferred that a plastic ring 37 be provided on the drum surface, and this ring is either made out of one plastic piece, or as shown in FIG. 3, the plastic may consist of plastic segments 39, to form a ring. Intermediate metal strips 41 may be provided, depending on whether the plastic employed provides enough rigidity for the drum. The microwave output is supplied through these plastic segments 39, as shown schematically by the arrow ML, as the drum rotates.

Figure 4:
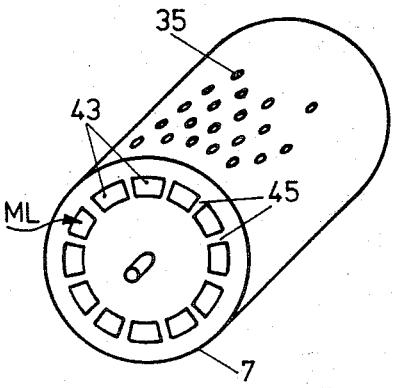
FIG. 4 is an alternative embodiment of a laundry drum wherein radiation-permeable sections are mounted on the front surface of the laundry drum.

An alternative design is shown in FIG. 4. If it is desired to supply the microwave radiation through the front of the drum 7, a uniform plastic ring can be provided, or as shown in FIG. 4, a plastic ring having plastic segments 43 separated by metal strips 45.

Figure 5:
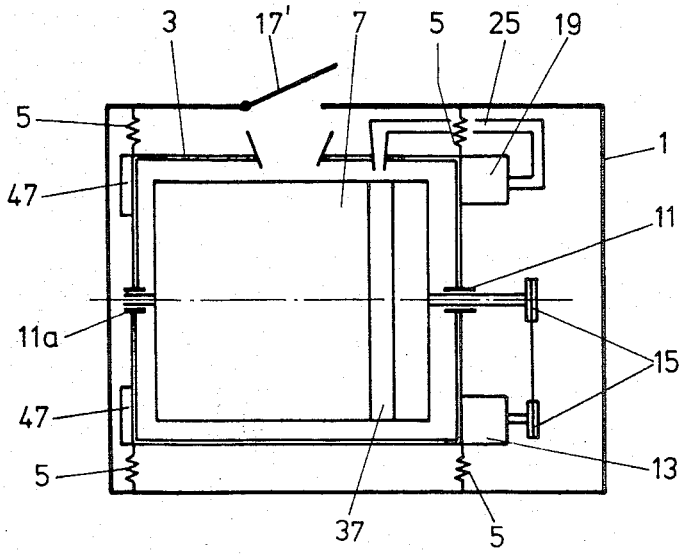
FIG. 5 illustrates an alternative design in which the microwave generator is mounted on the drum box as a compensating weight.

Referring to FIG. 5, showing the preferred embodiment, there is shown still another design, in which the wash drum 7 is supported by bearings 11 and 11*a* in the drum box 3. There is also provided a power drive unit 13, which drives the drum 7 via a belt and pulley arrangement 15, in a manner similar to FIG. 1. Springs 5 are provided for supporting the drum box 3 in the housing 1. In addition, stabilizing weights 47 are provided on the drum box 3 in order to increase the inertia and dampen the vibrations caused by any unbalance of the wash drum 7. The microwave generator 19 is mounted on the other end of the drum box 3 as a compensating weight as the preferred technique. The microwave energy is transmitted by a wave guide 25 and is transmitted to a plastic transmission ring 37 made of one piece or of several plastic segments on the drum surface, in the manner shown in FIG. 3. Of course, it should be understood that the laundry can also be filled through the front of the drum 7, as shown in FIG. 4 and introduced in FIG. 5 by dashed lines. Further, when the drum 7 is formed completely of plastic, or the plastic ring is provided else where on the drum the area of the drum at which the microwave power is transmitted therethrough can be chosen anywhere on such a drum. However, preventive measure are necessary, especially on door 17', in order to prevent radiation leakage from the drum to the outside.

Figure 6:
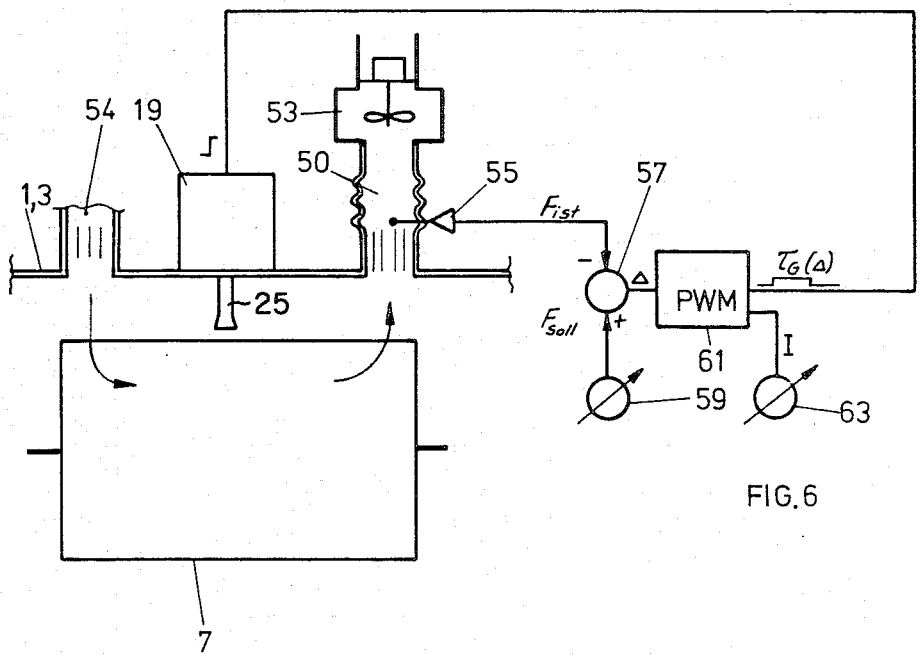
FIG. 6 is a partial representation of a machine according to FIGS. 1 or 5 having exhaust ventilators and a microwave generator output signal which is controlled by momentary humidity.

In FIG. 6, there is shown a block diagram for controlling the average generator output in response to the momentary humidity of the air in the drum 7. An air exhaust chimney 50 is provided, and is constructed as a honeycomb chimney which insulates the inside of the machine to its outside against transmission of microwave radiation. There is also a supply chimney 54, also constructed as a honeycomb chimney in order to insulate against such a transmission of microwave radiation. An exhaust fan 53 is disposed in exhaust chimney 50 and cooperates with supply chimney 54 to vent moist air out of the drum box 3 and the drum 7. It should be noted that the exhaust fan 53 is not provided in order to produce a convection current of the air in the drum 7 for the purpose of drying. It is only provided to vent the moist air and therefore can be of relatively low power. In the exhaust chimney 50, there is disposed a humidity detector 55 which converts the humidity of the moist air being vented from the drum 7 into an electrical signal. The actual moisture output signal $F_{IST}$ of the detector 55 is connected to a comparator 57, which also receives a preset rated moisture signal $F_{SOLL}$ from unit 59 of the desired humidity. The output signal of comparator 57, which represents the difference $\Delta$ between the actual humidity and the rated humidity, is connected to a pulse-width control unit 61 which generates at its output a steady pulse repetition frequency having a pulse width $\tau_{G(\Delta)}$ in proportion with the control difference $\Delta$. The output signal of unit 61 is connected to the control input of microwave generator 19, which may be a Magnetron. The pulse width at the output of the control unit 61 will shorten as the control difference $\Delta$ decreases, so that the average output of the microwave generator 19 will be decreased in response thereto. The maximum intensity of the microwave generator is, in this manner, adjusted in response to the moisture of the laundry to be dried. This can be achieved, for example, by presetting the maximum pulse width to $\tau_{Gmax}$ with the aid of a preset unit 63. The presetting of the rated humidity at the end of the drying process by preset unit 59, and the presetting of the maximum intensity of microwave generator 19 by preset unit 63, can both be controlled by a washing and/or drying program.

The above-described method is especially suited for the drying of laundry. Instead of employing a microwave generator, another source of radiation can be employed, for example, an infrared radiation source. It should be understood that the radiation must be chosen such that the space between the source of the radiation and the moisture or water to which the energy is to be supplied is to be as loss-free as possible. This is true in the case of microwave transmission, as described above, since the air which is between the microwave generating source and the water to receive the energy is practically loss-free.

As a result of the above-described method and apparatus, there is provided a substantial increase in efficiency of the laundry-drying process as compared to conventional methods in which air is heated and the heated air is then passed over the laundry to be dried.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for drying wet laundry or heating laundry water, comprising:

a drum suspended in a resiliently supported laundry housing and driven by a power unit;

said drum including an opening for loading laundry;

said drum including a radiation passage on one of its surfaces;

a source of radiation energy for directing said radiation energy through said radiation passage to the contents of said drum; and said radiation source being mounted on said laundry housing as a compensation weight.

2. Apparatus in accordance with claim 1 wherein said radiation source and said drum are rotatable relative to each other.

3. Apparatus in accordance with claim 1 wherein said radiation is microwave radiation.

4. Apparatus in accordance with claim 1 further including a wave guide connected to said radiation source for transmitting radiation directly from said source through said wave guide to said radiation passage.

5. Apparatus in accordance with claim 1 further including means for measuring the humidity inside said drum, and in response thereto, controlling the radiation output of said radiation source.

6. Apparatus in accordance with claim 1 further including means for adjusting the radiation output of said source according to the contents of said drum.

7. Apparatus in accordance with claim 1 wherein at least a portion of said drum is formed of plastic to form said radiation passage.

8. Apparatus in accordance with claim 1 further including a radiation transmitting device mounted on said drum.

9. Apparatus in accordance with claim 1 wherein said radiation passage is also a drum opening for loading said drum.

10. Apparatus in accordance with claim 1 wherein said radiation passage is formed on the front of said drum.

11. Apparatus in accordance with claim 1 wherein said drum includes water holes and said radiation passage is formed on the same surface as said water holes.

12. Apparatus in accordance with claim 1 wherein said radiation passage on said drum is in the form of plastic segments formed on said drum surface.

* * * * *

UNITED STATES PATENT AND TRADEMARK OFFICE

CERTIFICATE OF CORRECTION

PATENT NO. : 4,356,640

DATED : November 2, 1982

INVENTOR(S) : Christian Jansson

It is certified that error appears in the above—identified patent and that said Letters Patent is hereby corrected as shown below:

On the cover page, item [21] Appln. No. "266,459" should be changed to read --226,459--.

Signed and Sealed this

*Twenty-first* Day of *June 1983*

[SEAL]

*Attest:*

DONALD J. QUIGG

*Attesting Officer*

*Acting Commissioner of Patents and Trademarks*